US008820386B2

(12) United States Patent
Mullet et al.

(10) Patent No.: US 8,820,386 B2
(45) Date of Patent: Sep. 2, 2014

(54) MULTIPLE SHADE APPARATUS AND METHOD

(75) Inventors: Willis Jay Mullet, Gulf Breeze, FL (US); Christopher Lee Wysoczynski, Gulf Breeze, FL (US); Gerald Ashley Lee, Milton, FL (US)

(73) Assignee: QMotion Incorporated, Pensacola, FL (US)

( * ) Notice: Subject to any disclaimer, the term of this patent is extended or adjusted under 35 U.S.C. 154(b) by 195 days.

(21) Appl. No.: 13/506,836

(22) Filed: May 18, 2012

(65) Prior Publication Data

US 2013/0306250 A1 Nov. 21, 2013

(51) Int. Cl.
*A47G 5/02* (2006.01)

(52) U.S. Cl.
USPC ..... 160/241; 160/133; 160/25

(58) Field of Classification Search
CPC ..... E06B 9/40; E06B 9/42
USPC ..... 160/241, 120, 25, 23.1, 133, DIG. 16
See application file for complete search history.

(56) References Cited

U.S. PATENT DOCUMENTS

| | | | | |
|---|---|---|---|---|
| 2,280,358 | A * | 4/1942 | Tietig | 160/120 |
| 4,237,956 | A * | 12/1980 | Sivin et al. | 160/120 |
| 5,440,289 | A | 8/1995 | Riordan | |
| 5,552,769 | A | 9/1996 | Riordan | |
| 5,647,421 | A * | 7/1997 | Hoffmann et al. | 160/120 |
| 5,760,558 | A | 6/1998 | Popat | |
| 6,070,640 | A * | 6/2000 | Miyagawa et al. | 160/121.1 |
| 6,651,720 | B1 * | 11/2003 | DiSilvestro et al. | 160/121.1 |
| 6,817,399 | B2 | 11/2004 | Berman et al. | |
| 6,873,461 | B1 * | 3/2005 | McPherson, Jr. | 359/461 |
| 7,059,377 | B2 * | 6/2006 | Nien et al. | 160/120 |
| 7,093,643 | B2 * | 8/2006 | Ikle | 160/120 |
| 7,337,824 | B2 | 3/2008 | Berger | |
| 7,640,964 | B2 | 1/2010 | Berger | |
| 7,849,907 | B2 * | 12/2010 | Jang | 160/86 |
| 8,550,142 | B2 * | 10/2013 | Gaskill et al. | 160/121.1 |
| 2006/0027339 | A1 * | 2/2006 | Hsu | 160/120 |
| 2009/0277593 | A1 * | 11/2009 | Stewart | 160/127 |
| 2012/0043029 | A1 * | 2/2012 | Gaskill et al. | 160/121.1 |
| 2012/0097344 | A1 * | 4/2012 | Gaskill et al. | 160/168.1 V |
| 2012/0222824 | A1 * | 9/2012 | Lin | 160/25 |
| 2012/0291964 | A1 * | 11/2012 | Marocco | 160/120 |
| 2012/0291965 | A1 * | 11/2012 | Marocco | 160/120 |
| 2013/0068398 | A1 * | 3/2013 | Wills et al. | 160/26 |
| 2013/0098564 | A1 * | 4/2013 | Jang | 160/120 |

* cited by examiner

*Primary Examiner* — Katherine Mitchell
*Assistant Examiner* — Johnnie A Shablack
(74) *Attorney, Agent, or Firm* — Zarley Law Firm, P.L.C.

(57) ABSTRACT

A multiple shade apparatus and method includes a shade system with a shade header with end caps. A first shade roll is provided with a first shade connected with the first shade roll and the first shade includes a first bottom bar. The first shade roll is connected with the shade header. A second shade roll is provided with a second shade connected with the second shade roll and the second shade includes a second bottom bar. The second shade roll is also connected with the shade header. A first connector device is provided that is connected with the first shade and a second connector is connected with the second shade. A detachment device connected with the shade system is provided for automatically disconnecting the first connector and the second connector.

20 Claims, 10 Drawing Sheets

MULTIPLE SHADE APPARATUS AND METHOD

FIELD OF THE INVENTION

This invention relates to a multiple shade apparatus and method. In particular, in accordance with one embodiment, the invention relates to a multiple shade apparatus including a shade system with a shade header with end caps. A first shade roll is provided with a first shade connected with the first shade roll and the first shade includes a first bottom bar. The first shade roll is connected with the shade header. A second shade roll is provided with a second shade connected with the second shade roll and the second shade includes a second bottom bar. The second shade roll is also connected with the shade header. A first connector device is provided that is connected with the first shade and a second connector is connected with the second shade. A detachment device connected with the shade system is provided for automatically disconnecting the first connector and the second connector.

BACKGROUND OF THE INVENTION

A problem exists with regard to the use of shade systems with multiple shades. It is a problem to effectively and efficiently manipulate more than one shade in a shade system. The normal prior art procedure where more than one shade is deemed needed is to overlap two separate shade systems. Thus if it was desired that one shade was transparent to allow light in and another shade was opaque to keep light out, two entirely separate shade systems would be mounted in a light opening (window or door, for example). This obviously doubles the cost but it also doubles the complexity of the system. The user must master two operational systems instead of one. Further, the necessarily close proximity of the two separate systems often results in their entanglement. This reduces the effectiveness and desirability of the prior art dual overlapping systems.

Still further, there are systems that use expensive and elaborate electrical systems to connect, tilt and move shades and other elements of a shade system. Applicants are aware of the following prior art devices:

U.S. Pat. No. 5,440,289 to Riordan discloses a combined alarm system and window covering assembly that has a top housing assembly, bottom housing, and a covering. A conductive wire extends from the top housing assembly down to the bottom assembly and up from the bottom assembly to the top housing assembly and is used for raising and lowering the covering and the bottom housing. The conductive wire is electrically coupled to an alarm device. An enclosure is adapted to cover to the top housing assembly and an alarm device is disposed in the enclosure. A rotatable electrical connector and a roll-up mechanism for raising and lowering the covering and the bottom assembly may also be disposed in the top housing. The rotatable electrical connector electrically couples the alarm device to the conductive wire. An optical fiber may replace the conductive wire. An optical switching assembly includes a light bulb, an optical relay switch and a battery with the optical relay switch being optically coupled to the optical fiber and electrically coupled to the alarm device.

U.S. Pat. No. 5,552,769 to Riordan discloses a combined alarm system and window covering assembly that includes a top housing, a bottom rail having two ends, a covering, a conductive wire and two resiliently biased reed relay switches. The covering is mechanically coupled to the top housing and the bottom rail. The conductive wire has a first end and a second end and extends from the top housing down to the bottom rail and up from the bottom rail to the top housing. The conductive wire functions as a pull cord for raising and lowering the bottom rail and the covering. Each resiliently biased reed relay switch is mechanically coupled to one of the two ends of the bottom rail and electrically coupled to the conductive wire.

U.S. Pat. No. 5,760,558 to Popat discloses a system for automatic operation of venetian blinds and similar window coverings. A preferred embodiment, system 30, can be retrofitted to any conventional venetian blind without tools, removal of the blind, or installation of wiring (FIG. 10A). System 30 is attached to a blind 15 by a bracket 80, which engages a headrail 16 of blind 15, and is secured by a thumbscrew 84 (FIG. 4C). System 30 includes a gearmotor 85 which drives a coupling tube 91; coupling tube 91 is attached to a tilt-adjustment shaft 18 of blind 15 (FIG. 3A). The mechanical coupling between gearmotor 85 and coupling tube 91 includes a flexible coupling and an extensible coupling, which enables gearmotor 85 to rotate shaft 18 over a wide range of sizes and configurations of blind 15 (FIGS. 5A and 5B). System 30 also includes a photovoltaic source 31 mounted on a flexible member 99. Member 99 provides electrical connections to source 31, and supports it in an advantageous position to receive solar radiation (FIGS. 8B and 8C), regardless of the size and mounting arrangement of blind 15. System 30 also includes four momentary-contact electrical switches 38 to 41 and an actuating body 94, to which a tilt-control wand 19 of blind 15 can be attached. Together, actuating body 94 and switches 38 to 41 enable system 30 to be conveniently controlled by rotary and axial movements of wand 19 (FIG. 10A).

U.S. Pat. No. 6,817,399 to Berman et al. discloses a sheet material mounting system having a lifting sleeve, a center support bracket, an engaging rod and two or more lifting cords. The outer circumference of a left portion of the lifting sleeve is greater than the outer portion of a right portion of the lifting sleeve. The outer surface of the lifting sleeve forms a smooth concave surface. The lifting sleeve is configured to support a winding tube during operation of the mounting system. The lifting sleeve abuts against the center support bracket. The center support bracket includes guides for directing the lift cords onto the lifting sleeve. The lift cords are attached to a bottom leveling system for ensuring that the shade material remains parallel during system operation. As the shade is raised, the lifting cords wind around the outer surface of the lifting sleeve. The center support guides ensure that the lifting cords contact the lifting cone at an angle ensuring that the cords are wound (and unwound) un-stacked during mounting system operation. The cords are wound in unison and the shade remains parallel during raising and lowering.

U.S. Pat. No. 7,337,824 to Berger discloses magnetic tilt and raise/lower mechanisms for a venetian blind disposed between the glass panes of a multi-pane window. The magnetic mechanisms act on tilt lines and a raise/lower line coupled to the venetian blind. An inner follower carriage is magnetically coupled to an external carriage moveable over one of the glass panes. Movement of the external carriage imparts movement of the follower carriage, which in turn actuates the tilt or raise/lower lines, causing the venetian blind to move. The inner follower carriage and the external carriage include at least one magnet assembly mounted on at least one wheel set to facilitate movement of the carriages over the glass panes as well as to reduce the force required to raise or lower the venetian blind. A multiplier is employed to reduce the stroke length required to raise or lower the venetian blind.

Further, a clutch coupling an external slider to the external carriage is provided to disconnect the slider from the external carriage upon the application of a force exceeding a threshold level.

U.S. Pat. No. 7,640,964 to Berger discloses magnetic tilt and raise/lower mechanisms for a venetian blind disposed between the glass panes of a multi-pane window. The magnetic mechanisms act on tilt lines and a raise/lower line coupled to the venetian blind. An inner follower carriage is magnetically coupled to an external carriage moveable over one of the glass panes. Movement of the external carriage imparts movement of the follower carriage, which in turn actuates the tilt or raise/lower lines, causing the venetian blind to move. The inner follower carriage and the external carriage include at least one magnet assembly mounted on at least one wheel set to facilitate movement of the carriages over the glass panes as well as to reduce the force required to raise or lower the venetian blind. A multiplier is employed to reduce the stroke length required to raise or lower the venetian blind. Further, a clutch coupling an external slider to the external carriage is provided and to disconnect the slider from the external carriage upon the application of a force exceeding a threshold level.

What is still missing in the art is a shade system that enables the user to cover an opening with multiple shades in a single shade system while at the same time enabling independent use of a single shade when desired. Thus, there is a need in the art for a multiple shade system that enables two or more shades to be deployed singly or in combination when desired. Further, there is a need for a shade system that automatically disconnects separate shades and the thereafter allows independent operation of at least one shade. Further there is a need for an effective non-electric shade connection system that is adjustable at the place of use.

It therefore is an object of this invention, among other things, to provide a multiple shade system that enables two or more shades to be deployed singly or in combination when desired. Further, it is an object of this invention to provide a shade system that automatically disconnects separate shades and the thereafter allows independent operation of at least one shade. Still further, it is an object to provide an effective non-electric shade connection system that is adjustable at the place of use.

SUMMARY OF THE INVENTION

Accordingly, the multiple shade apparatus of the present invention, according to one embodiment, includes a shade system with a shade header with end caps. A first shade roll is provided with a first shade connected with the first shade roll and the first shade includes a first bottom bar. The first shade roll is connected with the shade header. A second shade roll is provided with a second shade connected with the second shade roll and the second shade includes a second bottom bar. The second shade roll is also connected with the shade header. A first connector device is provided that is connected with the first shade and a second connector is connected with the second shade. A detachment device connected with the shade system is provided for automatically disconnecting the first connector and the second connector.

All terms used herein are given there common meaning as known in the art unless otherwise defined. Thus, "shade system" describes a system for containing and deploying a shade. Shade systems include, among other things, a "header" for containing and concealing "shade rolls", typically cylindrical tubes, that carry "shades", material of various composition, that are connected at one end to the shade roll and, typically, at the other end of the shade to a "bottom bar". The bottom bar adds weight to the end of the shade not attached to the shade roll and helps create a light seal against the bottom of a window sill, for example only and not by way of limitation. Other common elements of a shade system are manual operation systems, pull cords or twist sticks for example only, or motors for manipulating the shades. The header also often includes a pair of "end caps" to shield the inner workings from view and, as will be described more fully hereafter, for use in support of the shade rolls and, uniquely herein, for the enablement of the automatic disconnecting of two joined shades.

In that regard, in accordance with another aspect of the present invention, a detachment device includes a guide in the header. The guide creates a receiver space and the second bottom bar is conformed to fit at least partially within the receiver space. The receiver space prevents movement of the second bottom bar past the receiver space. Further, a first stop is provided in the header. The first stop prevents movement of the first bottom bar past the first stop. The first stop is spaced apart from the receiver space such that when the first bottom bar is at the first stop the first bottom bar is spaced apart from the second bottom bar and automatically disconnecting them. That is, according to the invention, the non-electric physical separation of the two bottom bars operates to automatically separate them, all as will be more fully described hereafter.

In another aspect, the first connector is a magnet and the second connector is a metal bottom bar. In one aspect, the first connector is a magnet and the second connector is a magnet. In another aspect, the magnets are positioned such that opposite poles are aligned when the magnets are connected and misaligned when the magnets are disconnected.

In one aspect, a motor is connected with at least one shade roll and in another aspect a manual operating device is connected with at least one shade roll. In a further aspect, the shade connected with the first shade roll is a different material than the shade connected with the second shade roll. In one aspect, at least one of the shades is an opaque shade material.

According to another embodiment, a multiple shade apparatus includes a shade system with a shade header with end caps. A first shade roll is provided with a first shade connected with the first shade roll and the first shade includes a first bottom bar. The first shade roll is connected with the ends caps of the shade header. A second shade roll is provided with a second shade connected with the second shade roll and the second shade includes a second bottom bar. The second shade roll is connected with the ends caps of the shade header. A first non-electric connector is connected with the first bottom bar of the first shade and a second non-electric connector is connected with the second bottom bar of the second shade. A detachment device is located in the end caps of the shade system for automatically disconnecting the first connector and the second connector.

In one aspect of this embodiment of the invention, the detachment device includes a guide in the end caps. The guide creates a receiver space. The second bottom bar is conformed to fit at least partially within the receiver space and the receiver space prevents movement of the second bottom bar past the receiver space. A first stop is provided in the end caps that prevents movement of the first bottom bar past the first stop. The first stop is spaced apart from the receiver space such that when the first bottom bar is at the first stop the first bottom bar is spaced apart from the second bottom bar automatically disconnecting the first bottom bar and the second bottom bar.

In one aspect, the first non-electric connector is a magnet and the second non-electric connector is a metal bottom bar.

In another aspect, the first non-electric connector is a magnet and said second non-electric connector is a magnet. In a further aspect, the magnets are positioned such that opposite poles are aligned when the magnets are connected and misaligned when the magnets are disconnected.

In another aspect, the shade connected with the first shade roll is a different material than the shade connected with the second shade roll. In one aspect, when disconnected, either the first shade or the second shade is independently deployable from the shade system.

According to another embodiment of the invention, a method for manipulating multiple shades consists of:

a. providing a shade system with a shade header with end caps; a first shade roll, with a first shade connected with the first shade roll the first shade including a first bottom bar, where the first shade roll is connected with the shade header; a second shade roll, with a second shade connected with the second shade roll the second shade including a second bottom bar, where the second shade roll is connected with the shade header; a first connector connected with the first shade and a second connector connected with the second shade; and a detachment device connected with the shade system for automatically disconnecting the first connector and the second connector; and b. connecting the first connector and the second connector.

In another aspect, the method further includes operating the detachment device so as to disconnect the first connector and the second connector. In a further aspect, the first connector is a magnet located in the approximate middle of the first bottom bar and the second connector is a metal bottom bar. In one aspect, the shade connected with the first shade roll is a different material than the shade connected with the second shade roll.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
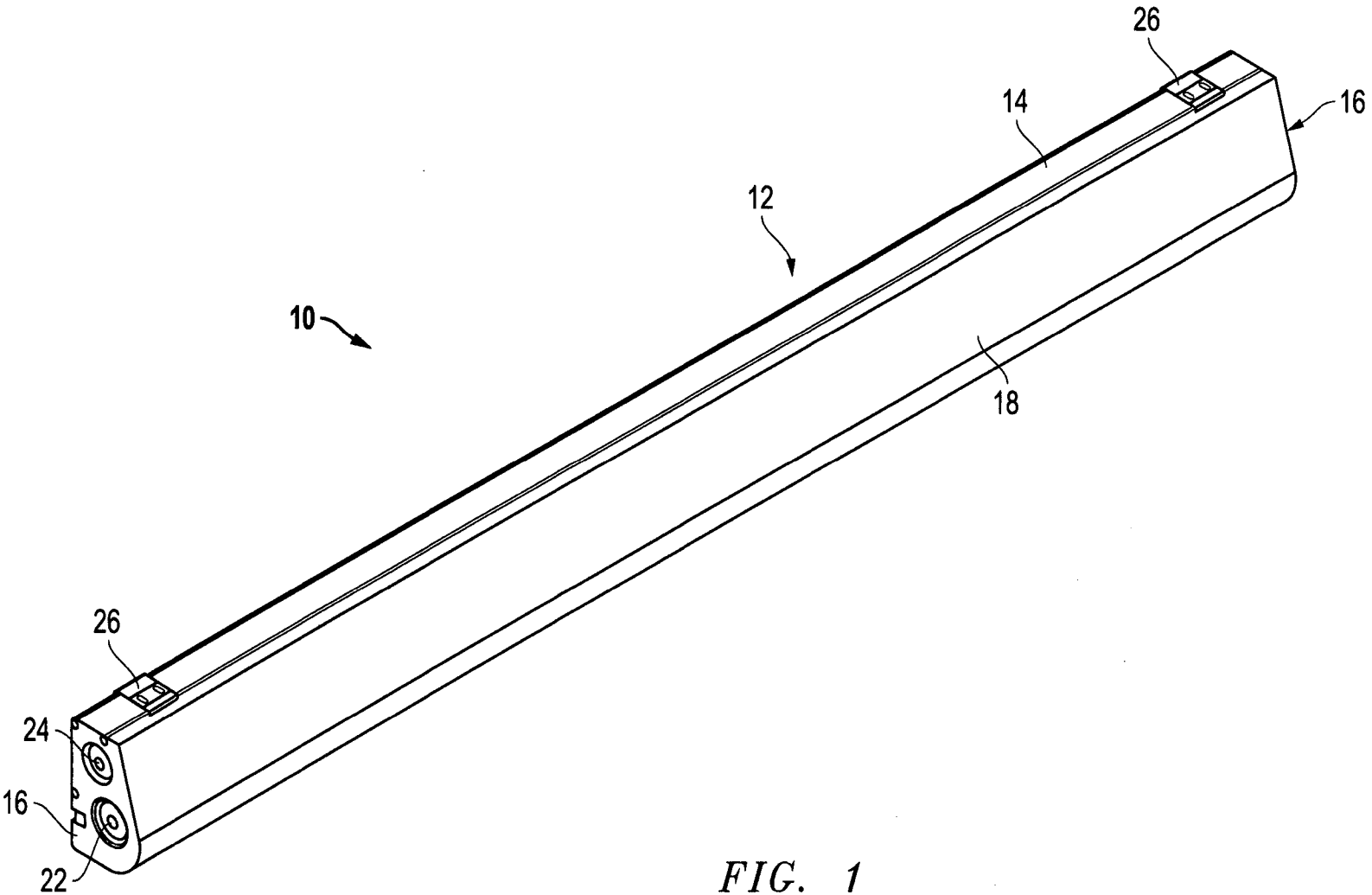
FIG. 1 is a perspective view of the exterior of the shade system and header of the present invention.
Figures 2, 3:
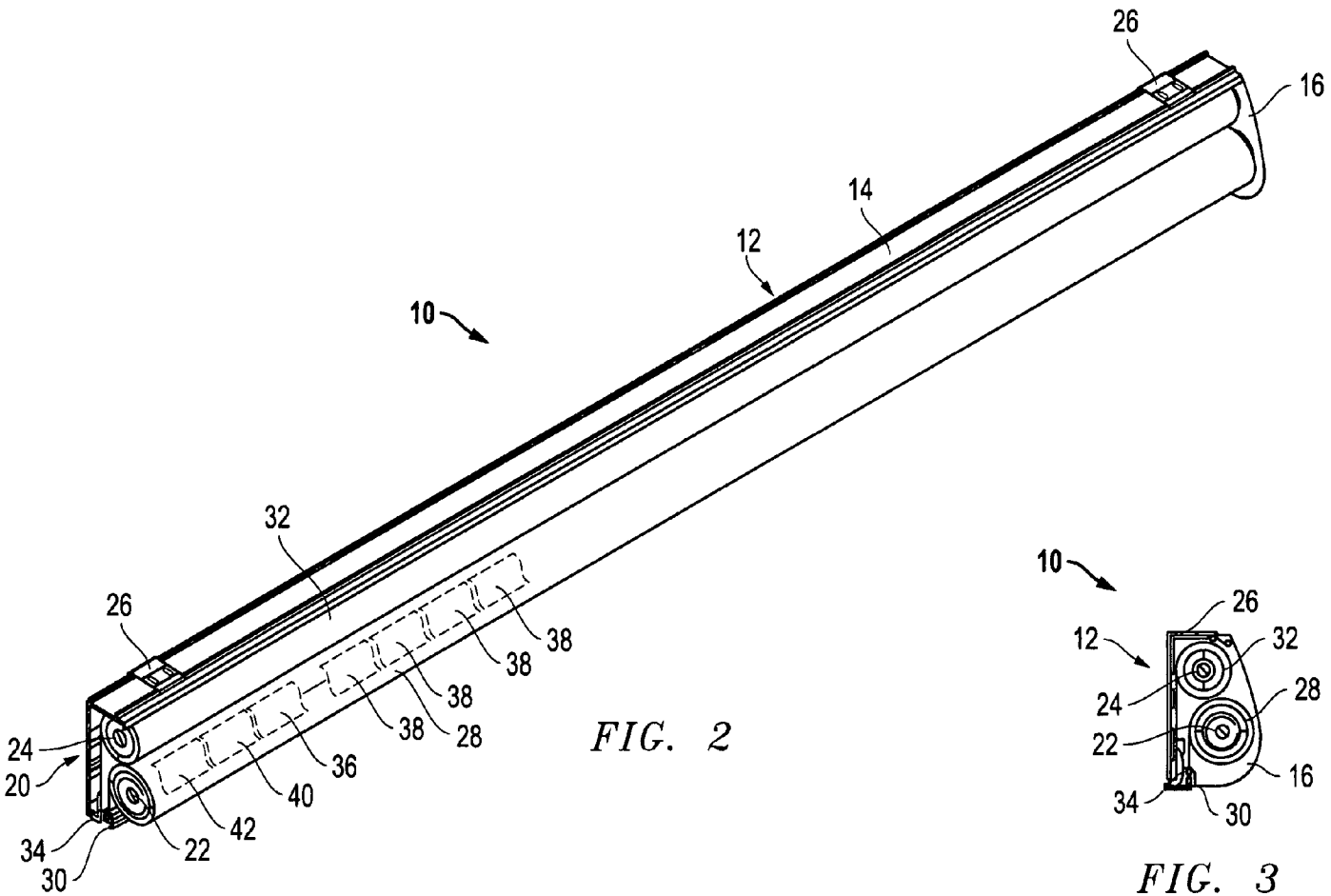
FIG. 2 is a perspective view of the invention of FIG. 1 with the front cover removed showing two shade rolls with a motor system shown in dotted lines within one shade roll.
FIG. 3 is an end view of the invention of FIG. 2.

The preferred embodiment of the present invention is illustrated by way of example in FIGS. 1-11. With specific reference to FIGS. 1-4, multiple shade apparatus 10 includes a shade system 12. Shade system 12 includes, among other things, a header 14 with end caps 16 and front cover 18. Together, header 14, end caps 16, and front cover 18 support and surround shade rolls 20. In a preferred embodiment as shown in FIGS. 1-3, two shade rolls 20 are provided, first shade roll 22 and second shade roll 24, as will be discussed more fully hereafter.

FIGS. 1-4 also show support brackets 26. Support brackets 26 are connectable with header 14 and are used to suspend shade system 12 in an opening such as a window or door (not shown), for example only and not by way of limitation.

Referring to FIGS. 2 and 3 specifically, the figures show that a first shade 28 is attached to first shade roll 22. In use, one end of first shade 28 is connected with first shade roll 22 and the rest of the first shade 28 is rolled onto the first shade roll 22 in overlapping layers. The other end of first shade 28 preferably is connected with a first bottom bar 30. Likewise, a second shade 32 is attached to second shade roll 24 in the same manner. Also, preferably, the free end of second shade 32 is connected with second bottom bar 34.

FIG. 2 shows a preferred embodiment in which a motor 36 powered by batteries 38 inside first shade roll 22, for example only, is connected with drive gear 40 so as to move the first shade roll 22 in one direction or the other as desired without manual intervention. Many modifications are possible including the connection of a computer device 42 with motor 36 to enable receipt of electronic signals from a remote control device (not shown) as for example only and as are known in the art and not disclosed more fully hereafter.

Figure 4:
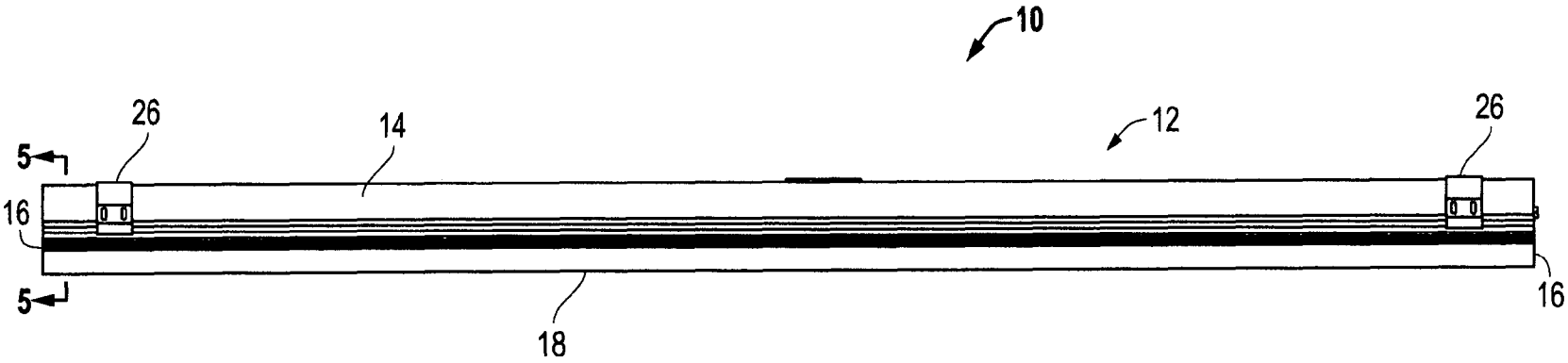
FIG. 4 is a top view of the invention of FIG. 2.
Figure 5:
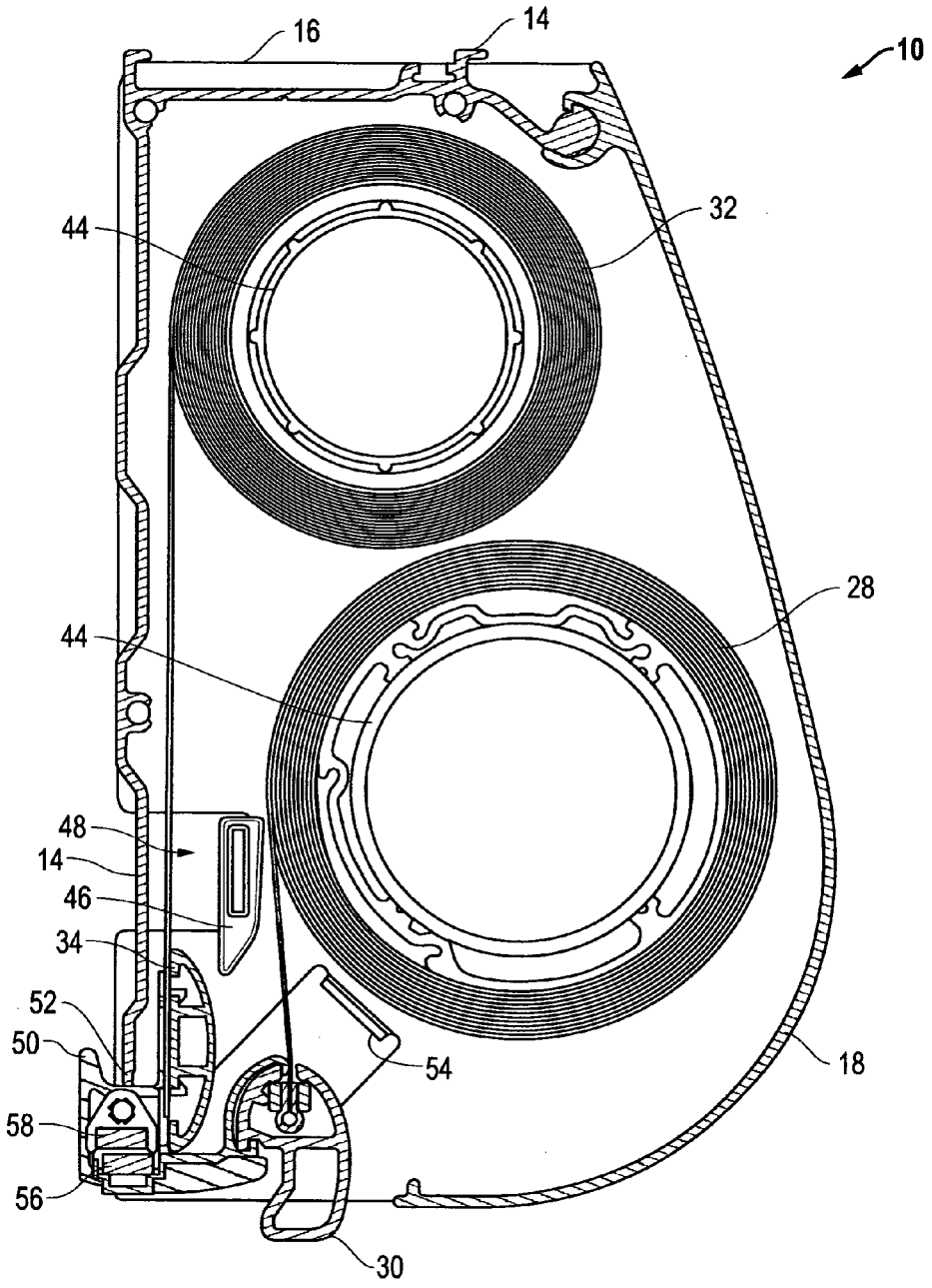
FIG. 5 is a side sectional view of FIG. 4 taken along line 5-5 showing the shades in the up position with the magnets attached.

Referring now to FIG. 5, FIG. 5 is a cross sectional end view at the end cap of one end taken along line 5-5 in FIG. 4. While shade rolls 20 may be supported within shade system 12 in any useful way, Applicants have found that using end caps 16 to support them as shown is preferable. Support shafts 44 connect with end caps 16 and enable rotational movement of the shade rolls 20.

First shade 28 is shown wrapped upon first shade roll 22 in the fully "up" or "retracted" position. Likewise, second shade 32 is shown wrapped upon second shade roll 24 also in the fully "up" or "retracted position. In this position, the second bottom bar 34 has been guided by guide 46 into receiver space 48. Receiver space 48 is formed by the combination of guide 46 and the inside of the back of header 14. Once second bottom bar 34 is drawn into receiver space 48 further upward movement beyond guide 46 is prevented. Additionally, second bottom bar 34 may include a grip 50 conformed to catch on edge 52 of the back of header 14 to ensure second bottom bar 34 does not move beyond the fully up position as shown in the figure.

Also illustrated is a first stop 54 in header 14. As will be described more fully with reference to FIG. 6, first stop 54 is spaced apart from the receiver space 48 and is conformed to stop upward movement of first bottom bar 30 when it is raised somewhat beyond the fully "up" position shown in FIG. 5 to the "detach" position shown in FIG. 6. It should be understood that the guide 46 and first stop 54 are preferably incorporated into the end caps 16.

Still referring now to FIG. 5, first connector 56, attached with first bottom bar 30, and second connector 58, attached with second bottom bar 34, are shown positioned so as to connect with each other. In one aspect, the first connector 56 and the second connector 58 are non-electric connectors. That is, in a preferred embodiment, first connector 56 is a magnet and second connector 58 is a magnet or a ferrous metal bottom bar, for example only. When the magnets are in the position shown in FIG. 5, the opposite poles are aligned and positioned across from each other. As a result the magnets are attracted to each other and first connector 56 and second connector 58 effectively join first bottom bar 30 with second bottom bar 34. In this position, movement of first shade 28 and movement of second shade 32 may be made together as a joined unit. It should be noted that the first connector 56 and the second connector 58 are located in the approximate middle of the respective bottom bars. Applicants have found that this prevents sagging of the shades or slanting of the bottom bars. Further, it is a feature of the invention that the connectors may be moved along the bottom bars as required in each application for most effective functioning.

Figure 6:
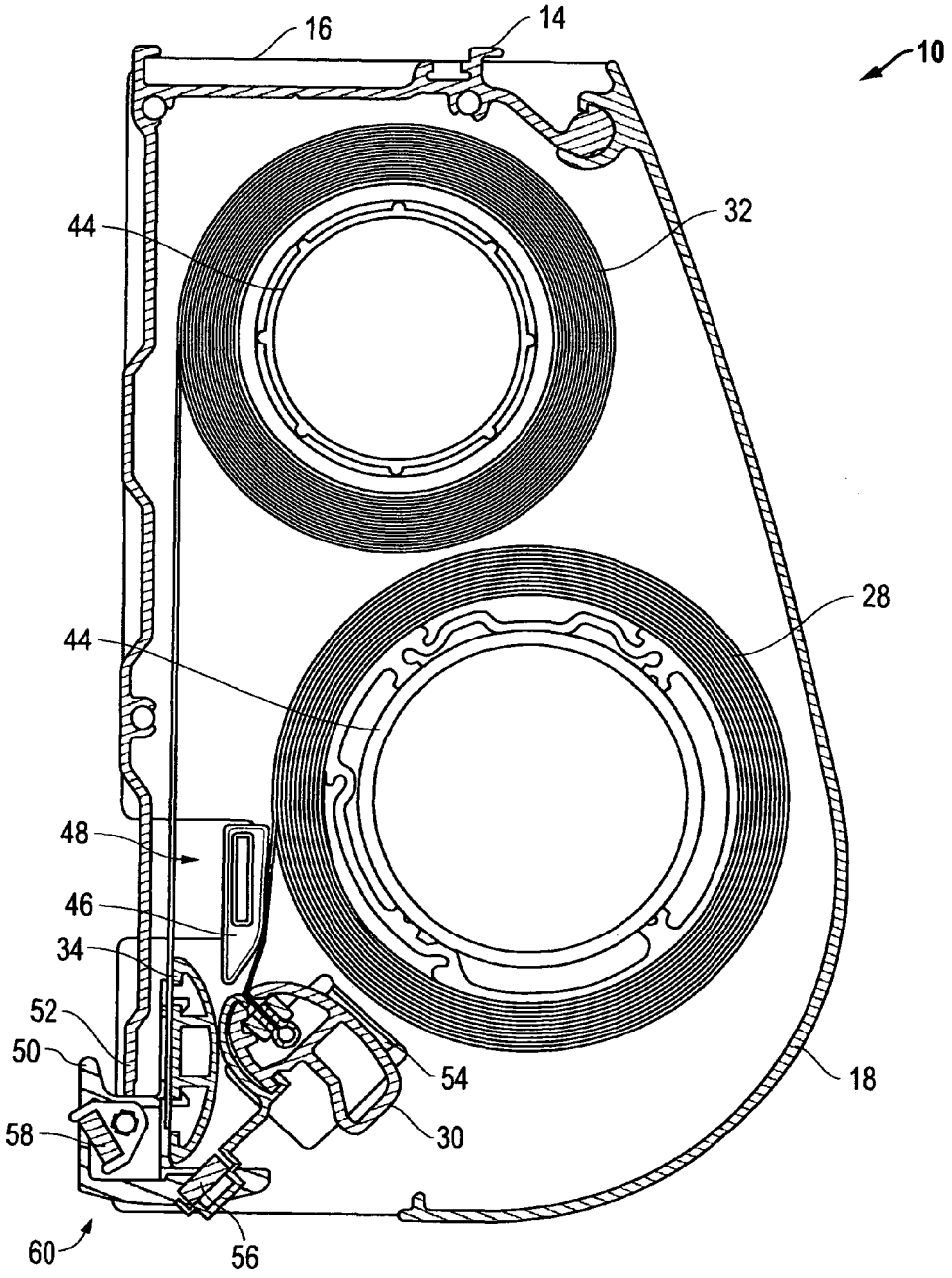
FIG. 6 is a view of FIG. 5 showing the magnet attached to the first shadefirst bottom rail in place at the first stop and pulled away from the magnet attached to the second bottom rail.
Figure 7:
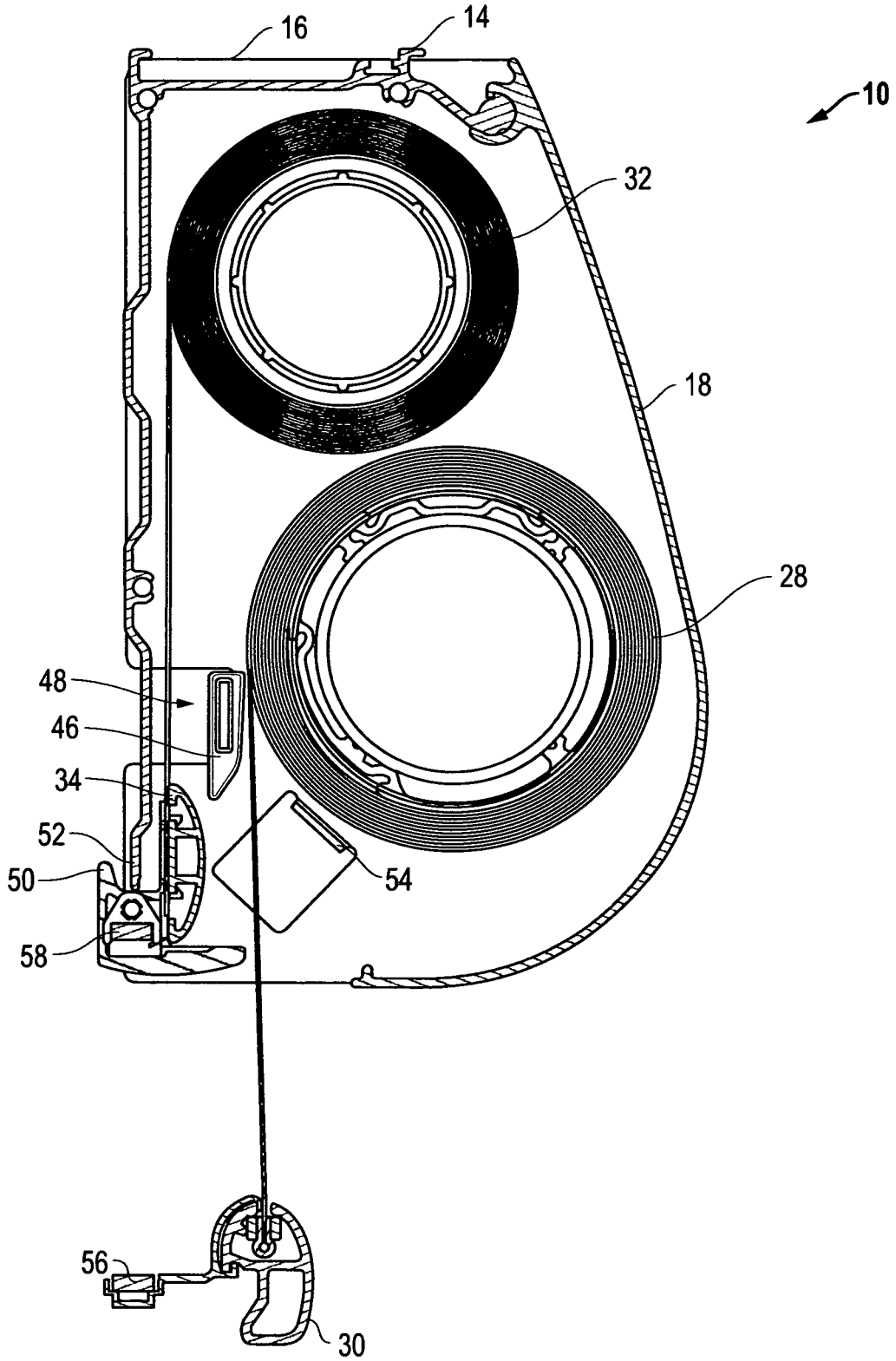
FIG. 7 is a view of FIG. 5 showing the magnet attached to the first shade first bottom rail separated from the magnet attached to the second bottom rail enabling the separate operation of the first shade without the second shade.
Figure 8:
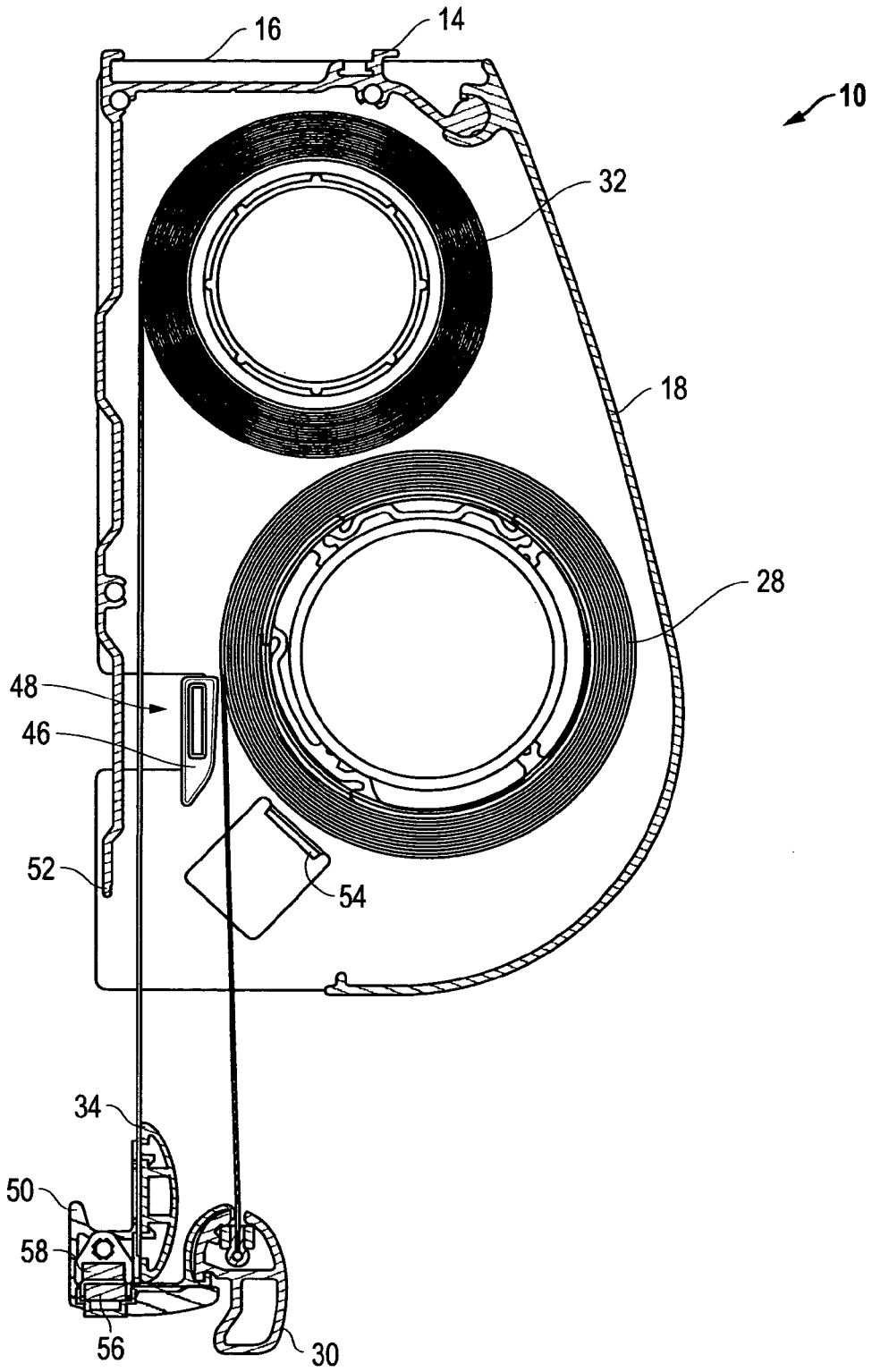
FIG. 8 is a view of FIG. 5 showing the first shade connected to the second shade and lowering together.
Figure 9:
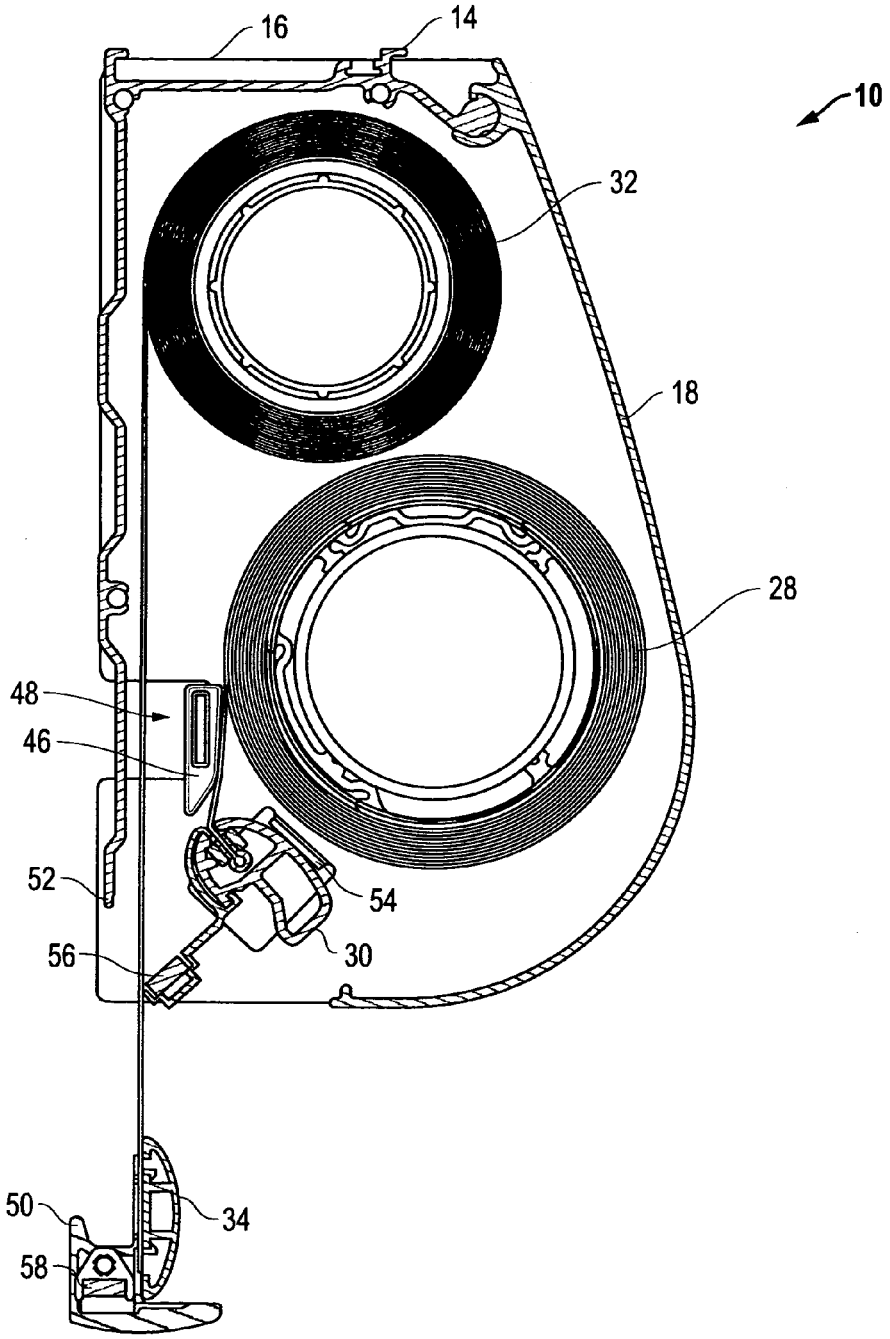
FIG. 9 is a view of FIG. 5 showing that, when disconnected, the second shade is also independently deployable.

Referring to FIG. 6, an important element of the invention is illustrated with detachment device 60. Detachment device 60 preferably includes first stop 54 spaced apart from receiver space 48 within which second bottom bar 34 is stopped. The first stop 54 and spaced apart receiver space 48, along with movement on first bottom bar 30 beyond the fully up position of FIG. 5, act together to automatically "detach" the two shades and place them in the "detach position" shown in this FIG. 6. In operation, detachment device 60 requires raising first bottom bar 30 to contact with first stop 54. At that point, slightly raising the first bottom bar 30 results in first bottom bar 30 being forced apart from second bottom bar 34, as shown. In that position, instead of first connector 56 being connected with second connector 58, they have been forced apart as a result of second bottom bar 34 being held motionless and first bottom bar 30 being pulled against first stop 54. In the case where the first connector 56 and the second connector 58 are magnets positioned such that opposite poles attract, movement of the first bottom bar 30 away from second bottom bar 34 actually enhances the detachment device 60 effectiveness in that like poles of the magnets repel. This assures that, when desired, first shade 28 may be raised and lowered without second shade 32 as shown in FIG. 7 and also that second shade 32 may be raised and lowered without first shade 28 as shown in FIG. 9. Referring to FIG. 8, however, when it is desired to combine the two shades, first bottom bar 30 is simply raised to contact second bottom bar 34 and first connector 56 connects with second connector 58 thus joining the two shades for simultaneous operation.

Again, the joining is facilitated in one embodiment in which the two connectors are magnets with opposite poles facing each other at the moment of contact. It may also be that only one connector is a magnet and the other connector is simply a ferrous metal bottom bar. Certainly other forms of connectors are included within the scope of the invention as well.

Figure 10:
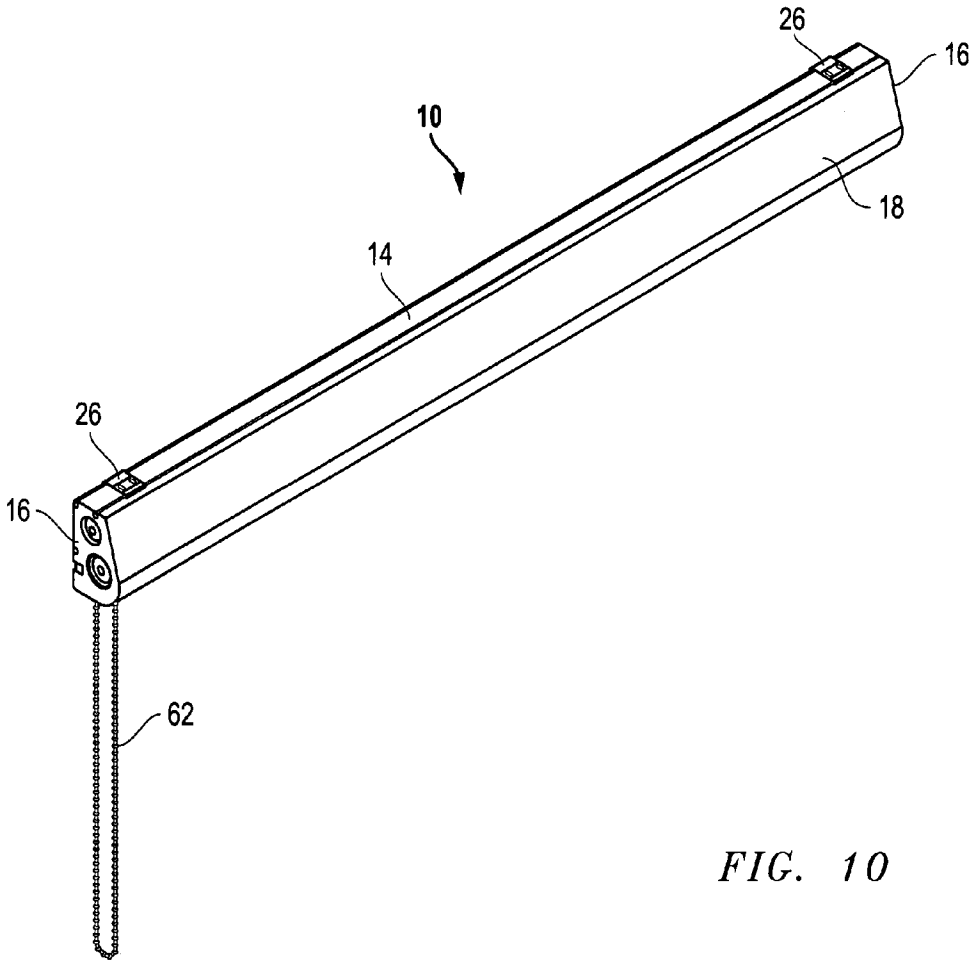
FIG. 10 is a perspective view of a manual operation shade system of the present invention.

Referring now to FIG. 10, another embodiment of the invention includes a manual shade manipulator, manual operating device 62. Manual operating device 62, such as a cord connected with shade rollers, may be used in place of motor 36 to manipulate the shade system 12 if desired. Such cord operated devices are well known in the art and is not described more fully herein.

Figure 11:
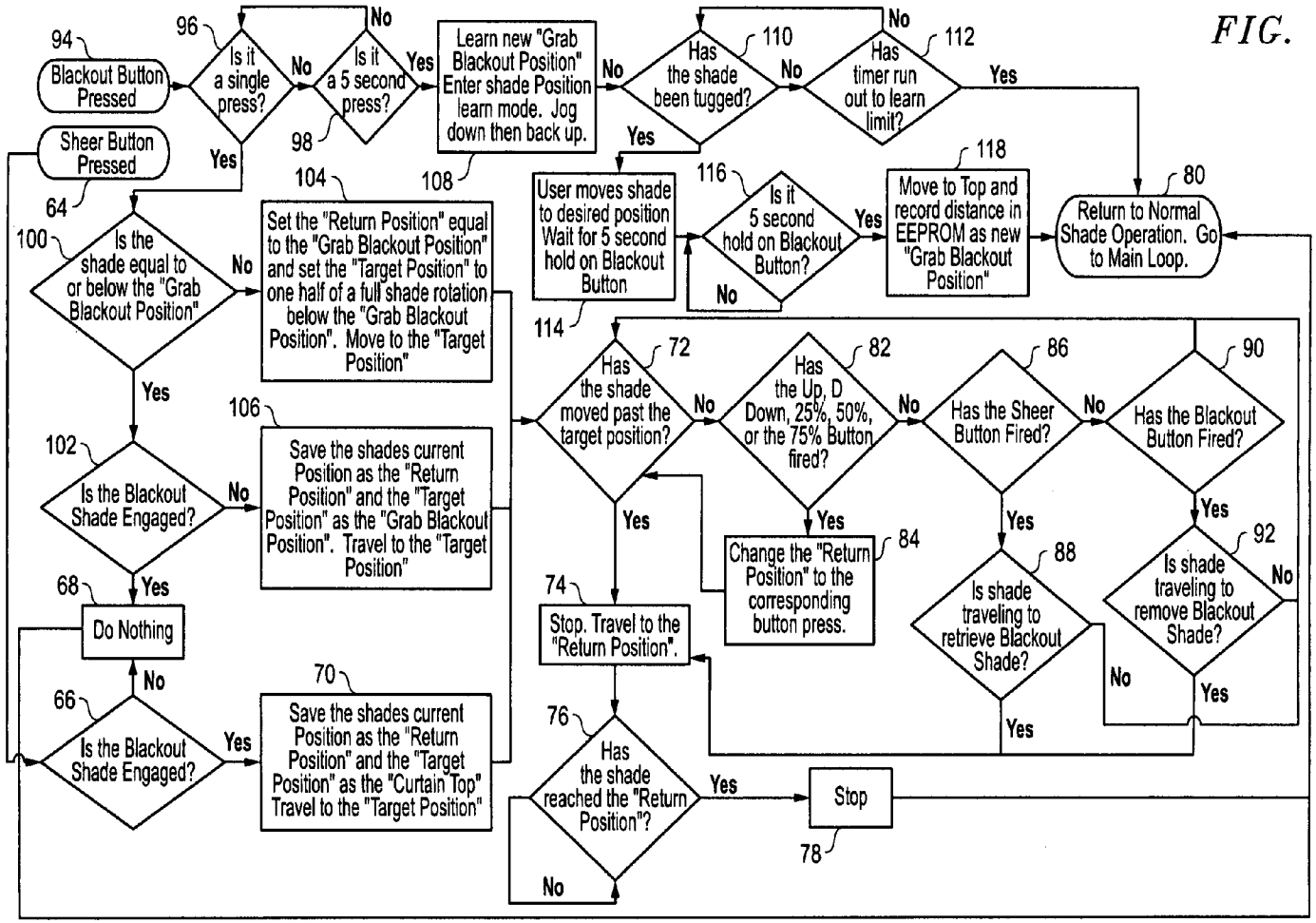
FIG. 11 is a flow chart of the operation of the multiple shade system of the present invention.

Referring now to FIG. 11 a schematic flow diagram of the operation of the multiple shade apparatus and method 10 of the present invention is presented. Again, it should be understood by now that it is preferable for first shade 28 to be made of a material that is different from material for second shade 32. Any material may be used and it is preferred that first shade material be transparent or sheer, or at least partly so, so as to admit light through an opening. In combination, second shade 32 is preferably made of opaque material such that light does not pass through it, so called "blackout" material. The flow chart shown in FIG. 11 is to be interpreted from the view of a shade system utilizing a computer device 42 in combination with motor 36. That is, it presents an automated shade system flow chart. The manipulation of the shades may, however, be manual.

Beginning at block 64 a "sheer" button is pressed (not shown) and the question is asked of the computer device "Is the blackout shade engaged?" at block 66. If the answer is "no" at block 68 nothing is done. If the answer is "yes" at block 70 the computer saves the shade's current position as the "return position" and sets the "target position" as the "curtain (shade) top" and moves the shade to the "target position".

At block 72 the question is asked, "Has the shade moved past the target position?". If the answer is "yes" at block 74 the shade is stopped and travels to the "return position". At block 76, the question is "Has the shade reached the 'return position' ? If "yes" the shade is stopped at block 78. If "no" the question at block 76 is re-presented until "yes". After block 78 the system moves to block 80 "Return to normal shade operation. Go to main loop" for new commands."

If at block 72 the answer is "no" the system asks at block 82 "Has the Up, Down, 25%, 50%, or 75% button fired?" if "yes" at block 84 the system changes the "return position" to the corresponding button press and returns to block 72. If "no" at block 86 the query is "Has the sheer button fired?". If "yes" at block 88 the question is "Is the shade traveling to retrieve the blackout shade?" If "yes" the system proceeds to block 74. If the answer is "no" at block 88 the system proceeds to block 72.

If at block 86 the answer is "no", the system proceeds to answer the question "Has the blackout button fired?" at block 90. If "no", the system proceeds to block 72. If "yes" the system proceeds to block 92 and decides "Is the shade traveling to remove (detach) the blackout shade?" If "no" the system proceeds to block 72. If "yes" the system proceeds to block 74.

If at block 94 the "blackout button" is pressed, the question at block 96 is "Is it a single press?". If "no", at block 98 the question is "Is it a 5 second press?". If the answer is "no" it returns to block 96. If the answer at block 96 is "yes", the question at block 100 is "Is the shade equal to or below the 'grab blackout shade (attach) position?" If "yes" it proceeds to block 102, "Is the blackout shade engaged?" If "yes" it proceeds to block 68.

If at block 100 the answer is "no" the system sets the "return position" equal to the "grab blackout position" and sets the "target position" to one half of a full shade rotation below the "grab blackout" position and moves the system to the "target position" at block 104. Thereafter the system moves to block 72.

If at block 102 the answer is "no" the system saves the shade's current position as the "return position" and the "target position" as the "grab blackout position" and moves to the "target position" at block 106 and then to block 72.

If at block 98 the answer is "yes", at block 108 the system learns the new "grab blackout position" and the user enters the system to move the shade to a new position as per block 110. At block 110 the question is "Has the shade been tugged manually?" If "no" at block 112 the question is "Has the timer run out to learn the new limit?" If "no" the system returns to block 110. If "yes" the system moves to block 80.

At block 110 if the answer is "yes" the system moves to block 114 where the user moves the shade to the desired position and waits for a five second hold on the blackout button. At block 116, the query is "Is the system at a five second hold on the blackout button?". If 'no" the system repeats to block 116. If "yes" the system moves to block 118 where it moves to the top and records the distance in the EEPROM (computer device) as the new "grab blackout position". After that the system proceeds to block 80.

By way of further description, the present multiple shade apparatus and method enables the operation of multiple roll shades or blinds, either manually or otherwise. A connector system, preferably a non-electric system such as magnets, attached to the bottom rails of the shades connects the shades together. This allows the use of different materials and fabrics for the two shades to alter the appearance of the window coverings and/or to provide privacy by use of "blackout" material. What is provided by way of the present invention is, among other things, a way to operate multiple shade rolls and shades with one motorized (for example) shade roll and magnets in both bottom bars so as to connect the separate shades so they operate as one unit when desired. A non-electric detachment device enables the user to separate the shades and operate one individually when desired.

The description of the present embodiments of the invention has been presented for purposes of illustration, but is not intended to be exhaustive or to limit the invention to the form disclosed. Many modifications and variations will be apparent to those of ordinary skill in the art. For example, more than two shades may be provided in a single shade system of the present invention. As such, while the present invention has been disclosed in connection with an embodiment thereof, it should be understood that other embodiments may fall within the spirit and scope of the invention as defined by the following claims.

What is claimed is:

1. A multiple shade apparatus comprising:

a shade system with a shade header with end caps;

a first shade roll, with a first shade connected with the first shade roll, the first shade including a first bottom bar, wherein the first shade roll is connected with the shade header;

a second shade roll, with a second shade connected with the second shade roll, the second shade including a second bottom bar, wherein the second shade roll is connected with the shade header;

a first connector connected with the first bottom bar and a second connector connected with the second bottom bar, wherein the first connector and the second connector connect to, and disconnect from, one another;

one of the first connector and the second connector include a magnet;

a detachment device connected with the shade system for automatically disconnecting the first connector from the second connector;

the detachment device further positioned in the shade header;

wherein when the first connector and the second connector are magnetically connected to one another and raised into the header, the detachment device forces the first bottom bar and the second bottom bar apart thereby breaking the magnetic connection between the first connector and the second connector.

2. The apparatus of claim 1 wherein the detachment device comprises:

a guide in the header wherein the guide creates a receiver space, wherein the second bottom bar is conformed to fit at least partially within the receiver space and wherein the receiver space prevents movement of the second bottom bar past the receiver space; and a first stop in the header wherein the first stop prevents movement of the first bottom bar past the first stop and wherein the first stop is spaced apart from the receiver space such that when the first bottom bar is at the first stop the first bottom bar is spaced apart from the second bottom bar, automatically disconnecting the first bottom bar and the second bottom bar.

3. The apparatus of claim 1 wherein the first connector is a magnet and the second connector is a metal bottom bar.

4. The apparatus of claim 1 further including a motor connected with at least one shade roll.

5. The apparatus of claim 1 further including a manual operating device connected with at least one shade roll.

6. The apparatus of claim 1 wherein the shade connected with the first shade roll is a different material than the shade connected with the second shade roll.

7. The apparatus of claim 1 wherein at least one of the shades is an opaque shade material.

8. The apparatus of claim 1 wherein the first connector is a magnet and the second connector is a magnet.

9. The apparatus of claim 8 wherein the magnets are positioned such that opposite poles are aligned when the magnets are connected and misaligned when the magnets are disconnected.

10. A multiple shade apparatus comprising:

a shade system with a shade header with end caps;

a first shade roll, with a first shade connected with the first shade roll, the first shade including a first bottom bar, wherein the first shade roll is connected with the ends caps of the shade header;

a second shade roll, with a second shade connected with the second shade roll, the second shade including a second bottom bar, wherein the second shade roll is connected with the ends caps of the shade header;

a first non-electric connector connected with the first bottom bar of the first shade and second non-electric connector connected with the second bottom bar of the second shade;

a detachment device in the end caps of the shade system for automatically disconnecting the first connector and the second connector;

the detachment device further positioned in the shade header; one of the first connector and the second connector include a magnet;

wherein when the first connector and the second connector are magnetically connected to one another and raised into the header, the detachment device forces the first bottom bar and the second bottom bar apart thereby breaking the magnetic connection between the first connector and the second connector.

11. The apparatus of claim 10 wherein the detachment device comprises:

a guide in the end caps wherein the guide creates a receiver space, wherein the second bottom bar is conformed to fit at least partially within the receiver space and wherein the receiver space prevents movement of the second bottom bar past the receiver space; and a first stop in the end caps wherein the first stop prevents movement of the first bottom bar past the first stop and wherein the first stop is spaced apart from the receiver space such that when the first bottom bar is at the first stop the first bottom bar is spaced apart from the second bottom bar automatically disconnecting the first bottom bar and the second bottom bar.

12. The apparatus of claim 10 wherein the first non-electric connector is a magnet and the second non-electric connector is a metal bottom bar.

13. The apparatus of claim 10 wherein shade connected with the first shade roll is a different material than the shade connected with the second shade roll.

14. The apparatus of claim 10 wherein when disconnected, either the first shade or the second shade is independently deployable from the shade system.

15. The apparatus of claim 10 wherein the first non-electric connector is a magnet and the second non-electric connector is a magnet.

16. The apparatus of claim 15 wherein magnets are positioned such that opposite poles are aligned when the magnets are connected and misaligned when the magnets are disconnected.

17. A method for manipulating multiple shades comprising:

providing a shade system with a shade header with end caps; a first shade roll, with a first shade connected with the first shade roll the first shade including a first bottom bar, wherein the first shade roll is connected with the shade header; a second shade roll, with a second shade connected with the second shade roll the second shade including a second bottom bar, wherein the second shade roll is connected with the shade header; a first connector connected with the first shade and a second connector connected with the second shade; and a detachment device connected with the shade system wherein the detachment device automatically disconnects the first connector and the second connector by applying a force between the first bottom bar and the second bottom bar when the first connector and the second connector are connected for automatically disconnecting the first connector and the second connector.

18. The method of claim 17 further including operating the detachment device so as to disconnect the first connector and the second connector.

19. The method of claim 17 wherein the first connector is a magnet located in the approximate middle of the first bottom bar and the second connector is a metal bottom bar.

20. The method of claim 17 wherein the shade connected with the first shade roll is a different material than the shade connected with the second shade roll.

* * * * *